US010723984B2

(12) United States Patent
Shin

(10) Patent No.: US 10,723,984 B2
(45) Date of Patent: Jul. 28, 2020

(54) ENVELOPE TYPE DETERGENT

(71) Applicant: LG HOUSEHOLD & HEALTH CARE LTD., Seoul (KR)

(72) Inventor: Man Sup Shin, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 63 days.

(21) Appl. No.: 15/517,258

(22) PCT Filed: Sep. 2, 2015

(86) PCT No.: PCT/KR2015/009213
§ 371 (c)(1),
(2) Date: Apr. 6, 2017

(87) PCT Pub. No.: WO2016/060378
PCT Pub. Date: Apr. 21, 2016

(65) Prior Publication Data

US 2017/0313962 A1 Nov. 2, 2017

(30) Foreign Application Priority Data

Oct. 16, 2014 (KR) ..... 10-2014-0140016

(51) Int. Cl.
*C11D 17/06* (2006.01)
*C11D 17/04* (2006.01)
(Continued)

(52) U.S. Cl.
CPC ..... *C11D 17/06* (2013.01); *C11D 1/83* (2013.01); *C11D 3/10* (2013.01); *C11D 3/2044* (2013.01);
(Continued)

(58) Field of Classification Search
None
See application file for complete search history.

(56) References Cited

U.S. PATENT DOCUMENTS 3,279,511 A * 10/1966 Griffin, Jr. ..... A45C 11/24 128/DIG. 24
3,663,449 A * 5/1972 Susuki et al. ..... C11D 3/08 206/524.1
(Continued)

FOREIGN PATENT DOCUMENTS

CN 103614896 A 3/2014
DE 202009009335 U1 11/2009
(Continued)

OTHER PUBLICATIONS

"Water soluble laundry bag for infection control in hospitals", website: https://www.youtube.com/watch?v=sRXfnGKI4cc, (Dec. 26, 2012).
(Continued)

*Primary Examiner* — Lorna M Douyon
(74) *Attorney, Agent, or Firm* — Birch, Stewart, Kolasch & Birch, LLP

(57) ABSTRACT

The present invention relates to a detergent composition for preparing an envelope type detergent, the detergent composition including: a) a non-ionic surfactant; b) an anionic surfactant; c) a film forming water-soluble polymer; d) an alkali builder; and e) a plasticizer, and an envelope type detergent prepared therefrom.

8 Claims, 1 Drawing Sheet

(51) Int. Cl.

| | |
|---|---|
| ***C11D 1/83*** | (2006.01) |
| ***C11D 1/28*** | (2006.01) |
| ***C11D 1/72*** | (2006.01) |
| ***C11D 3/10*** | (2006.01) |
| ***C11D 3/20*** | (2006.01) |
| ***C11D 3/37*** | (2006.01) |
| ***C11D 3/386*** | (2006.01) |

(52) U.S. Cl.
CPC ..... *C11D 3/2065* (2013.01); *C11D 3/2093* (2013.01); *C11D 3/3753* (2013.01); *C11D 3/386* (2013.01); *C11D 17/042* (2013.01); *C11D 1/28* (2013.01); *C11D 1/72* (2013.01)

(56) References Cited

U.S. PATENT DOCUMENTS

| | | | | |
|---|---|---|---|---|
| 4,828,744 | A * | 5/1989 | Kaufmann | C08J 5/18 206/524.7 |
| 6,525,014 | B1 * | 2/2003 | Gorlin | B32B 5/26 510/439 |
| 2007/0269651 | A1 * | 11/2007 | Denome | A61K 8/0208 428/327 |
| 2008/0242572 | A1 * | 10/2008 | Icht | C11D 17/043 510/120 |
| 2010/0190677 | A1 | 7/2010 | Esposito et al. | |
| 2011/0028374 | A1 * | 2/2011 | Fossum | C11D 3/0052 510/296 |
| 2011/0127270 | A1 | 6/2011 | Hartman et al. | |
| 2014/0274859 | A1 | 9/2014 | Adamy | |

FOREIGN PATENT DOCUMENTS

| | | | |
|---|---|---|---|
| KR | 10-0814285 | B1 | 3/2008 |
| KR | 10-2010-0090122 | A | 8/2010 |
| KR | 10-2012-0021449 | A | 3/2012 |
| KR | 10-1443497 | B1 | 9/2014 |
| WO | WO 00/46342 | A1 | 8/2000 |
| WO | WO 02/12615 | A1 | 2/2002 |

OTHER PUBLICATIONS

Zhang Yulong, "Plastic Blow Molding Article of Manufacturing Formulation Design and Processing Example," National Defense Industry Press, Jan. 31, 2006, pp. 102-106.

* cited by examiner

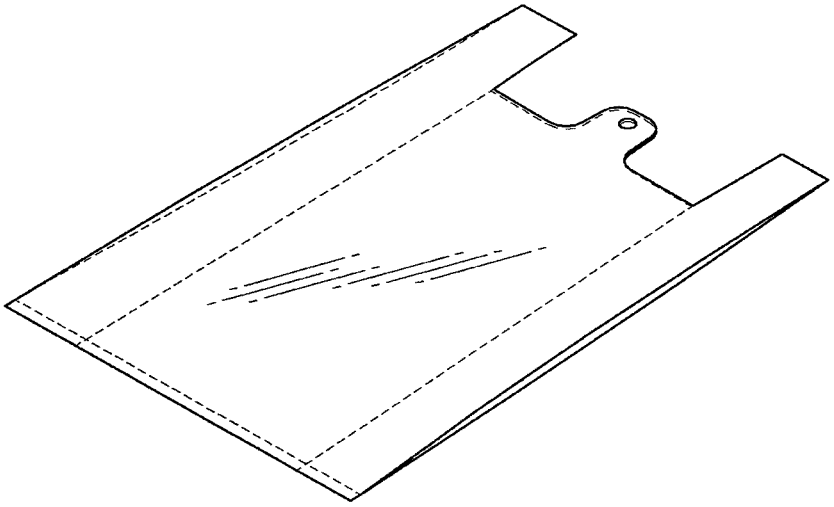

ENVELOPE TYPE DETERGENT

CROSS REFERENCE TO RELATED APPLICATIONS

This application is the National Phase of PCT/KR2015/009213 filed on Sep. 2, 2015, which claims priority under 35 U.S.C. § 119(a) to Patent Application No. 10-2014-0140016 filed in the Republic of Korea on Oct. 16, 2014, all of which are hereby expressly incorporated by reference into the present application.

TECHNICAL FIELD

The present invention relates to a detergent for laundry, and particularly, to an envelope type detergent capable of containing the laundry.

BACKGROUND ART

In general, the laundry is washed by introducing a detergent into a washing machine, and consumers directly weigh the detergent based on the amount of laundry regardless of the type of detergent. Most consumers are using a detergent based on a standard amount of detergent used depending on the amount of laundry, which is suggested as a method of using a detergent, but it is actually difficult to exactly determine the amount of laundry and the standard amount of detergent used, and users arbitrarily measure the amount of detergent and use the detergent. Accordingly, there is a problem in that a desired washing effect cannot be obtained because the detergent is used excessively or sparingly. Further, due to the problems associated with a space and costs, the laundry is usually gathered and stored until a pile of the laundry reaches a predetermined level, and then the laundry is classified and introduced into a washing machine to wash the laundry, and the odor and touch from the laundry stored during the classifying process cause discomfort and cumbersomeness.

A detergent for being introduced into a washing machine is available in the form of a powder, a liquid, a capsule, a sheet, and the like. The powder type detergent has a problem in that the powder is scattered or the powder phase remains on the laundry, and the liquid type detergent has a disadvantage in that consumers are hesitant to use the liquid type detergent due to the relative heavy weight. In order to improve the problems, capsule type and sheet type detergents using a polymer film material are currently available.

The polymer film material is a material of which the use in daily products has been recently rapidly increased, and has been widely used in the field of the household products including medicines, cosmetics and detergents. For example, the polymer film material has been used as a base material such as a transparent film for packaging food, a skin-attachable sheet for medical use or skin improvement, a capsule-type detergent, and a sheet-type detergent.

The capsule-type detergent and the sheet-type detergent are detergents using a water-soluble film, and numerous researches and developments for the detergents have been conducted because the detergents can be conveniently divided into smaller sizes and can alleviate disadvantages of powder detergents and liquid detergents.

Specifically, Korean Patent Application Laid-Open No. 10-2012-0021449 discloses a sheet for laundry, in which a film forming water-soluble polymer including detergent ingredients and softener ingredients distributed among polymer chains thereof is solidified in the form of a film. Korean Patent Application Laid-Open No. 1999-0030414 discloses a water-soluble polyvinyl alcohol film, a gelatin film, a starch film, a cellulose film, and the like as a material for a disposable hermetic sealing type detergent which contains a one-time standard use amount in a bag in order to prevent a powder detergent from being scattered and protect water quality by inducing consumers to use a suitable amount. Korean Patent Application Laid-Open No. 2004-0067668 discloses a technology of packaging a liquid cleaner with a water-soluble film.

However, when a detergent is divided and packaged by using water-soluble polymer films, there are problems in that a hermetically sealed portion is broken open in a process of storing or transporting the detergent, and as a result, there are problems in that a phenomenon in which contents therein are leaked out occurs, active ingredients ooze out from the surface of the film, and the storage stability of product significantly deteriorates. Further, a water-soluble film is used as a packaging material for detergent and thus is designed so as to secure the stability against moisture in the atmosphere and the durability of contents therein. For the reason, there is a problem in that it takes considerable time to dissolve a detergent at a temperature of water typically used during the laundry, and the film containing the detergent is not completely dissolved, and as a result, residues of the film remain. A sheet type detergent can significantly alleviate disadvantages of the capsule type detergent, but has a disadvantage in that it is difficult to use an appropriate amount of detergent according to the laundry, and still has a problem caused by storing the laundry until the laundry is laundered.

DISCLOSURE

Technical Problem

Thus, the present invention has been made in an effort to provide an envelope type detergent capable of containing a predetermined amount of laundry.

Further, the present invention has been made in an effort to provide a detergent composition for preparing an envelope type detergent capable of containing the laundry.

Technical Solution

In order to solve the above-described problems, the present invention provides an envelope type detergent capable of containing the laundry. The envelope type detergent according to the present invention includes detergent ingredients solidified in a polymer film.

According to an appropriate exemplary embodiment of the present invention, the envelope type detergent is preferably a film phase having a thickness of 0.004 μm to 2.0 mm.

Further, the present invention provides a detergent composition for preparing an envelope type detergent capable of containing the laundry.

According to an appropriate exemplary embodiment of the present invention, the detergent composition preferably includes: a) 3 to 40 parts by weight of a non-ionic surfactant; b) 5 to 40 parts by weight of an anionic surfactant; c) 5 to 90 parts by weight of a film forming water-soluble polymer as a total weight of the film after being dried; d) 1 to 30 parts by weight of an alkali builder; and e) 1 to 20 parts by weight of a plasticizer.

According to another appropriate exemplary embodiment of the present invention, as a) the non-ionic surfactant, one or more may be selected from the group consisting of polyoxyethylene alkyl ether, coconut diethanolamide, fatty acid alkanolamine, amine oxide, alkyl polyglucoside, methyl polyethylene alkyl ether, and sugar ether.

According to still another appropriate exemplary embodiment of the present invention, as b) the anionic surfactant, one or more may be selected from the group consisting of alpha sulfo fatty acid methyl ester salt, alpha-olefin sulfonate, and sodium lauryl sulfate.

According to yet another appropriate exemplary embodiment of the present invention, c) the film forming water-soluble polymer is preferably a polyvinyl alcohol having a degree of saponification of 75 to 95% and an average degree of polymerization of 100 to 3,000.

According to still yet another appropriate exemplary embodiment of the present invention, as d) the alkali builder, one or more may be selected from the group consisting of sodium carbonate, sodium bicarbonate, and sodium sulfate.

According to a further appropriate exemplary embodiment of the present invention, as e) the plasticizer, one or more may be selected from the group consisting of trimethylol propane, ethylene glycol, dibutyl phthalate, and citric acid.

According to another further appropriate exemplary embodiment of the present invention, the detergent composition may additionally include one or more additives selected from the group consisting of a perfume, a proteolytic enzyme, a lipolytic enzyme, a carbohydrolytic enzyme, a cellulolytic enzyme, a bleaching agent, a fluorescent dye, and a migration proofing agent in an amount of 0.3 to 10 parts by weight based on 100 parts by weight of the detergent composition.

Advantageous Effects

An envelope type detergent according to the present invention may be used while the laundry is introduced into a detergent envelope formulated into a disposable preparation, so that the amount of detergent used is easily quantified.

Further, since an envelope type detergent having various sizes may be provided, each laundry is stored in an envelope, and then the laundry may be laundered while the detergent envelope is introduced into a washing machine when the laundry is laundered. Therefore, it is possible to eliminate the chore of classifying the laundry after the laundry is stored and discomfort occurring due to the storing of the laundry.

In addition, the solubility of the detergent in cold water is excellent, the aggregation phenomenon due to moisture during the laundering process scarcely occurs, no detergent residue remains when the laundry is laundered, the storage stability is excellent, and the storage convenience is excellent.

The foregoing summary is illustrative only and is not intended to be in any way limiting. In addition to the illustrative aspects, embodiments, and features described above, further aspects, embodiments, and features will become apparent by reference to the drawings and the following detailed description.

DESCRIPTION OF DRAWINGS

FIG. 1 is a perspective view illustrating an envelope type detergent prepared according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

BEST MODE

Hereinafter, the present invention will be described in detail with reference to drawings and Examples.

In describing the present invention, detailed descriptions related to publicly known functions or configurations will be omitted in order not to obscure the gist of the present invention.

The present inventors have studied on a method capable of solving the problem in that a washing effect cannot be completely obtained by excessively or sparingly using the detergent when the laundry is laundered, and capable of eliminating the chore in that the laundry is stored in the same container until a pile of the laundry reaches a predetermined level, and then the laundry need to be classified according to various classification criteria, and the discomfort caused by storing the laundry, thereby completing the present invention.

The envelope type detergent according to the present invention is an envelope capable of containing the laundry, and includes detergent ingredients solidified in a polymer film. The shape of the envelope is not particularly limited, and any shape can be adopted as long as the shape can contain the laundry. The size of the envelope is also not particularly limited, and the envelope may be prepared in various sizes. An envelope type detergent has an advantage in that the laundry complying with the classification criteria can be contained and stored together in an envelope from the time when the laundry is produced. Further, the envelope type detergent has an advantage in that a suitable amount of detergent may be used because the laundry which may be contained in the envelope is limited.

In the envelope type detergent, a polymer film including detergent ingredients has a thickness of preferably 0.004 μm to 2.0 mm, and more preferably 0.01 to 0.5 mm. When the thickness is less than 0.004 μm, the tensile strength is reduced, and the product stability as an envelope type detergent is poor. When the thickness is more than 2.0 mm, there occurs a problem in that the solubility of the detergent is reduced. The envelope type detergent has the strength of 5.0 to 100.0 $N/mm^2$, and preferably 30.0 to 50.0 $N/mm^2$. The strength within the range is preferred in terms of solubility of the detergent, storing property of the laundry, and use convenience.

The envelope type detergent is preferably prepared from a detergent composition including: a) 3 to 40 parts by weight of a non-ionic surfactant; b) 5 to 40 parts by weight of an anionic surfactant; c) 5 to 90 parts by weight of a film forming water-soluble polymer as a total weight of the film after being dried; d) 1 to 30 parts by weight of an alkali builder; and e) 1 to 20 parts by weight of a plasticizer.

In the present specification, the "film forming water-soluble polymer" means a water-soluble polymer capable of forming a film, and has a film-forming property capable of forming a film matrix, but when the laundry is laundered, entangled polymer chains of the film forming water-soluble polymer are disentangled by water again.

In the detergent composition for the envelope type detergent of the present invention, a) the non-ionic surfactant may compensate the cleaning ability in laundry water of high hardness, and thus may improve the cleaning power of the detergent. The non-ionic surfactant is not particularly limited, but preferred examples thereof include polyoxyethylene alkyl ether, coconut diethanolamide, fatty acid alkanolamine, amine oxide, alkyl polyglucoside, methyl polyethylene alkyl ether, sugar ether, or the like. In addition, preferably, one or more may be selected and used from the group consisting of the non-ionic surfactants described above.

It is preferred that the non-ionic surfactant is included in an amount of 3 to 40 parts by weight based on the total weight of the detergent composition for the envelope type detergent. When the content is less than 3 parts by weight, there is a problem in that the cleaning power is low, and when the content is more than 40 parts by weight, there is a problem in that it is not easy to prepare the envelope type detergent according to the present invention.

Next, b) the anionic surfactant is to serve as a detergent like the non-ionic surfactant, and is not particularly limited, but preferred examples thereof include alpha sulfo fatty acid methyl ester, alpha-olefin sulfonate, or sodium lauryl sulfate. In addition, preferably, one or more may be selected and used from the group consisting of the anionic surfactants described above.

It is preferred that the anionic surfactant is included in an amount of 5 to 40 parts by weight based on the total weight of the detergent composition for the envelope type detergent. When the content is less than 5 parts by weight, there is a problem in that the cleaning power is low, and when the content is more than 40 parts by weight, there is a problem in that it is not easy to prepare the envelope type detergent according to the present invention.

Next, preferred examples of c) the film forming water-soluble polymer include polyvinyl alcohol (PVA) or a polyvinyl alcohol-based copolymer, and in order to secure the solubility and achieve the forming property of a film in the form of an envelope, it is preferred that the film forming water-soluble polymer has a degree of saponification of 75 to 95% and an average degree of polymerization of 100 to 3,000. When the degree of saponification is less than 75% or more than 95%, the film forming water-soluble polymer has low solubility, and thus is not dissolved well in water. Further, when the average degree of polymerization is less than 100, the molecular weight is so low that the film is not easily formed, and physical properties such as the tensile strength of the film are not good. When the average degree of polymerization is more than 3,000, the molecular weight is so high that the film forming water-soluble polymer is hardly dissolved in water, and even though the polymer is dissolved in water, the viscosity is so high that it is difficult to formulate the film forming water-soluble polymer into a film.

It is preferred that the film forming water-soluble polymer is included in an amount of 5 to 90 parts by weight as a total weight of a film after being dried, based on the total weight of the detergent composition. When the content is less than 5 parts by weight, it is difficult to prepare a film due to the low tensile strength, and when the content is more than 90 parts by weight, the content of active ingredients for laundry is so low that the detergent function deteriorates.

Next, d) the alkali builder increases the pH in the detergent composition for the envelope type detergent, and thus increases repulsion between fibers, thereby improving the power of removing dirt. Further, since it is possible to prevent the pH of the detergent composition from being excessively increased by an appropriate combination with acidic ingredients, it is possible to reduce the possibility of dye migration which may occur when the laundry is laundered at high temperature due to high pH. In addition, the alkali builder serves to maintain the pores of a water-soluble polymer via a neutralization reaction with acidic ingredients, thereby impregnating detergent ingredients in the polymer film.

As the alkali builder, soda ash, sodium carbonate, sodium bicarbonate, sodium sulfate, or the like may be used, and one or more thereof may be selected and used. The higher the content of sodium bicarbonate and sodium sulfate is, the higher the density is, so that when sodium bicarbonate and sodium sulfate are used in consideration of the aforementioned property, it is preferred to adjust the content thereof. Sodium carbonate and sodium bicarbonate are also used as a pH adjusting agent, and thus may serve to buffer the pH of laundry water.

The alkali builder may be typically used by appropriately adjusting the content thereof according to the purpose, but is included in an amount of preferably 1 to 30 parts by weight based on the total weight of the detergent composition in the present invention. When the alkali builder is used in an amount of less than 1 part by weight, the pores of the polymer film are formed in a small amount, and as a result, it is difficult to impregnate detergent ingredients in the polymer film, and when the alkali builder is used in an amount of more than 30 parts by weight, the solubility of the envelope type detergent prepared is reduced.

Next, e) the plasticizer is a film forming initiator of a polymer, and is used in order to impart ductility to the envelope type detergent. Preferred examples thereof include trimethylol propane, ethylene glycol, dibutyl phthalate, and citric acid, and one or more may be selected and used from the examples described above.

It is preferred that the plasticizer is included in an amount of 1 to 20 parts by weight based on the total weight of the detergent composition. When the plasticizer is used in an amount of less than 1 part by weight, the polymer film is not formed well, and when the plasticizer is used in an amount of more than 20 parts by weight, the ductility is increased so much that the strength of film suitable as an envelope type detergent may not be obtained.

Further, within a range not inhibiting the object of the present invention, a detergent composition for an envelope type detergent according to the present invention may additionally include an additive such as a proteolytic enzyme such as protease, a lipolytic enzyme such as lipase, a carbohydrolytic enzyme such as amylase, a cellulolytic enzyme such as cellulase, a biphenyl-based or stilbene-based fluorescent dye, a bleaching agent such as sodium percarbonate, or a migration proofing agent in an amount of 0.3 to 10 parts by weight based on 100 parts by weight of the detergent composition. When a portion of these additives is included in the detergent composition for the envelope type detergent, it is preferred that each of the proteolytic enzyme, the lipolytic enzyme, the carbohydrolytic enzyme, and the cellulolytic enzyme is additionally included in an amount of 0.01 to 1 part by weight based on 100 parts by weight of the detergent composition. Alternatively, it is preferred that the fluorescent dye is additionally included in an amount of 0.1 to 1 part by weight based on 100 parts by weight of the detergent composition, and it is preferred that the migration proofing agent is additionally included in an amount of 0.5 to 5 parts by weight based on 100 parts by weight of the detergent composition.

The envelope type detergent according to the present invention is prepared as an envelope type detergent by a preparation method including: uniformly mixing raw materials which constitute the composition ingredients of the detergent; making the mixture into a film; and preparing the filmed detergent composition in the form of an envelope. In addition, when the raw materials are mixed, the above-described additives may be additionally mixed according to the purpose. The additive may also be introduced into the outer form of the detergent envelope in a post-processing form, if necessary.

When the raw materials are mixed, it is preferred that the additive is introduced within a temperature range in consideration of the boiling point of a surfactant and the melting point of a polymer.

MODE FOR INVENTION

Hereinafter, preferred examples are presented in order to help understand the present invention, but the following examples are only provided to illustrate the present invention and the scope of the present invention is not limited to the following Examples.

EXAMPLE

An envelope type detergent was prepared from the raw materials shown in the following Table 1 by using a screw introducing apparatus at a heating temperature of 140° C. and a blowing film casting apparatus. The prepared envelope type detergent has a form as illustrated in FIG. 1. In Table 1, the unit means wt %. As a result of measuring the tensile strength of the prepared detergent envelope, the tensile strength was 49.11 N/mm$^2$.

The tensile strengths of the detergent envelopes prepared in the Example and the Comparative Examples to be described below were measured under the following conditions.

Device used: Jinan Lingyue Accurate Instrument, LX-180 Model

Sample size: 30 mm×30 mm

Tensile speed: 50 mm/min

Temperature: 15° C.

Comparative Example 1

An envelope type detergent was prepared in the same manner as in the Example with the constitution as shown in the following Table 1. As a result of the preparation, a plasticizer was not contained, and as a result, the polymer film was not formed well, and was hardened in the form of a lump inside the screw apparatus. Furthermore, when the envelope type detergent was prepared with the constitution in Comparative Example 1, it was shown that the tensile strength was significantly low and ductility was not exhibited. The tensile strength was 25.16 N/mm$^2$.

Comparative Example 2

A preparation was carried out in the same manner as in the Example with the constitution shown in Table 1, except that when the screw was introduced, the heating temperature was set to 160° C., which is higher than that in the Example. As a result of carrying out the preparation, a film as an envelope type detergent was not formed. This is because the water-soluble polymer and the surfactant were volatilized by mixing the raw materials at high temperature, and as a result, the film was not formed. Further, due to bubbles generated during the volatilization, the uniformity of the contents deteriorated, the tensile strength was significantly reduced, and as a result, the breakage phenomenon occurred during the process of preparing the envelope type detergent.

Comparative Example 3

A preparation was carried out in the same manner as in the Example under the constitution shown in the following Table 1. As a result of carrying out the preparation, a film as an envelope type detergent was not formed. It is determined that this is because excessive amounts of surfactant were aggregated with a polymer. In addition, it is determined that an excessive amount of surfactant brought about a reduction in surface tension, the reduction induced gelling of the total raw materials, and as a result, a film as an envelope type detergent was not formed.

TABLE 1

| Classification | | Example | Comparative Example 1 | Comparative Example 2 | Comparative Example 3 |
|---|---|---|---|---|---|
| Water-soluble polymer | PVA (polyvinyl alcohol) | 86.00% | 88.00% | 86.00% | 44.00% |
| Plasticizer | TMP (trimethylol propane) | 2.00% | — | 2.00% | 2.00% |
| Non-ionic surfactant | LA-7 mol (polyoxyethylene alkyl ether) | 3.00% | 3.00% | 3.00% | 45.00% |
| Anionic surfactant | MES (methyl estersulfonate 85%) | 6.50% | 6.50% | 6.50% | 6.50% |
| Alkali builder | Sodium carbonate (soda ash) | 2.50% | 2.50% | 2.50% | 2.50% |
| Additive | Proteolytic enzyme | 0.50% | 0.50% | 0.50% | 0.50% |
| Introduction temperature | | 140° C. | 140° C. | 160° C. | 140° C. |

INDUSTRIAL APPLICABILITY

The detergent composition for the envelope type detergent according to the present invention may prepare an envelope type detergent retaining the strength capable of containing the laundry. Further, the envelope type detergent according to the present invention can be easily quantified when the detergent is used for laundry, and storage stability and storage convenience thereof are excellent. Therefore, the detergent composition may be used very usefully when a detergent in which the user's convenience is enhanced is prepared.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A detergent in the form of an envelope capable of containing laundry, the detergent comprising a detergent composition, the detergent composition comprising:

5 to 40 parts by weight of an anionic surfactant; 3 to 40 parts by weight of a nonionic surfactant;

50 to 90 parts by weight of a film forming water-soluble polymer as a total weight of the film after being dried;

1 to 30 parts by weight of an alkali builder; and 1 to 20 parts by weight of a plasticizer, wherein the film forming water-soluble polymer is a polyvinyl alcohol having a degree of saponification of 75 to 95% and an average degree of polymerization of 100 to 3,000, wherein the detergent is a film phase having a thickness of 0.004 μm to 2.0 mm and has a strength of 30.00 to 100.0 $N/mm^2$, and wherein the detergent composition is uniformly mixed, the mixture is made into a film, and the film is prepared in the form of the envelope.

2. The detergent in the form of the envelope of claim 1, wherein detergent ingredients are solidified and comprised in the film phase.

3. The detergent in the form of the envelope of claim 1, wherein, as the non-ionic surfactant, one or more are selected from the group consisting of polyoxyethylene alkyl ether, coconut diethanolamide, fatty acid alkanolamine, amine oxide, alkyl polyglucoside, methyl polyethylene alkyl ether, and sugar ether.

4. The detergent in the form of the envelope of claim 1, wherein, as the anionic surfactant, one or more are selected from the group consisting of alpha sulfo fatty acid methyl ester salt, alpha-olefin sulfonate, and sodium lauryl sulfate.

5. The detergent in the form of the envelope of claim 1, wherein, as the alkali builder, one or more are selected from the group consisting of soda ash, sodium carbonate, sodium bicarbonate, and sodium sulfate.

6. The detergent in the form of the envelope of claim 5, wherein, as the alkali builder, one or more are selected from the group consisting of soda ash, sodium bicarbonate, and sodium sulfate.

7. The detergent in the form of the envelope of claim 1, wherein, as the plasticizer, one or more are selected from the group consisting of trimethylol propane, ethylene glycol, dibutyl phthalate, and citric acid.

8. The detergent in the form of the envelope of claim 1, wherein the detergent composition additionally comprises one or more additives selected from the group consisting of a perfume, a proteolytic enzyme, a lipolytic enzyme, a carbohydrolytic enzyme, a cellulolytic enzyme, a bleaching agent, a fluorescent dye, and a migration proofing agent in an amount of 0.3 to 10 parts by weight based on 100 parts by weight of the detergent composition.

* * * * *